US010080404B2

(12) United States Patent
Chou

(10) Patent No.: US 10,080,404 B2
(45) Date of Patent: Sep. 25, 2018

(54) FASTENING FABRIC

(71) Applicants: Chao-Mu Chou, Taipei (TW); Shiu-Yin Cheng, Taipei (TW)

(72) Inventor: Chao-Mu Chou, Taipei (TW)

(73) Assignees: Chao-Mu Chou, Taipei (TW); Shiu-Yin Cheng, Taipei (TW)

( * ) Notice: Subject to any disclaimer, the term of this patent is extended or adjusted under 35 U.S.C. 154(b) by 280 days.

(21) Appl. No.: 15/152,472

(22) Filed: May 11, 2016

(65) Prior Publication Data

US 2016/0345688 A1 Dec. 1, 2016

(30) Foreign Application Priority Data

May 28, 2015 (TW) ..... 104117138 A
Apr. 13, 2016 (TW) ..... 105111563 A

(51) Int. Cl.
*A44B 18/00* (2006.01)

(52) U.S. Cl.
CPC ..... *A44B 18/0023* (2013.01)

(58) Field of Classification Search
CPC ..... Y10T 24/275; Y10T 24/2758; Y10T 24/2733; Y10T 24/2725; A44B 18/0034; A44B 18/0038; A44B 18/0084; A44B 18/0088; A44B 18/0023
See application file for complete search history.

(56) References Cited

U.S. PATENT DOCUMENTS 5,745,961 A * 5/1998 Okawa ..... A44B 18/0023 24/442
7,231,789 B2 6/2007 Chou
8,656,564 B2 2/2014 Chou
2012/0096690 A1 4/2012 Chou

* cited by examiner

*Primary Examiner* — Robert Sandy
(74) *Attorney, Agent, or Firm* — Guice Patents PLLC

(57) ABSTRACT

A fastening fabric having a restraining fabric structure, including a first base structure and plural fiber bundles protruding from a surface of the first base structure, wherein each of the fiber bundles has plural inclined restraining fibers, and the plural inclined restraining fibers are formed with a rigidity and inclined towards a same direction, and respectively formed with an included angle with respect to the surface of the first base structure; and a loop fabric structure, including a second base structure and plural loop bundles protruding from a surface of the second base structure, wherein each of the loop bundles has plural fibriform loops; when the restraining fabric structure and the loop fabric structure are in contact for being mutually adhered, the inclined restraining fibers and the fibriform loops are tangled with each other to provide an adhering and fastening effect.

39 Claims, 8 Drawing Sheets

FASTENING FABRIC

BACKBASE OF THE INVENTION

1. Field of the Invention

The present invention relates to a fastening fabric, especially to a fastening fabric made of a soft structure.

2. Description of Related Art

Fastening fabrics have been developed to overcome the disadvantage of a Velcro or hook and loop fastener that the hook structure thereof is overly rigid, and examples can be seen in Taiwan Pat. No. M263013 (equivalent to U.S. Pat. No. 7,231,789) titled in "Snapping Fabrics", Taiwan Pat. No. I376210 (equivalent to U.S. Pat. No. 8,656,564) and Taiwan Pat. No. I432151 (equivalent to U.S. patent application Ser. No. 13/277,398).

According to what has been disclosed in Taiwan Pat. No. M263013, a hairiness treatment is used to form fibriform hooks of the fastening fabric, so the fibriform hooks are not provided with a uniform directivity, thereby causing a poor adhering and fastening effect when the fibriform hooks are engaged with fibriform loops. Referring to FIG. 1, which discloses a fastening fabric proposed by Taiwan Pat. No. I432151, the fastening fabric 1 comprises a micro-fibriform loop fabric structure 10 and a fibriform pile fabric structure 20, the micro-fibriform loop fabric structure 10 is formed with a plurality of erected micro-fibriform loop bundles 101 protruding from a surface of a base structure 30, each of the micro-fibriform loop bundles 101 comprises a plurality of micro-fibriform loops 102; the fibriform pile fabric structure 20 is formed with a plurality of erected fiber bundles 201 protruding from another surface of the base structure 30, each of the fiber bundles 201 comprises a plurality of upwardly erected restraining fibers 202 having the top end being in a non-hook status. As such, there are disadvantages caused when the restraining fibers 202 are tangled with the micro-fibriform loops 102, as follows:

(1) As for the adhering and fastening effect in the vertical direction: where the fibriform hooks and the fibriform loops of the fastening fabric are mutually engaged in the vertical direction, as the external pulling force is in parallel with the erected and dispersed restraining fibers, there is no effective vertical resisting force, and the tangled status in the vertical direction would be very easy to dissolve, thereby causing the fastening fabric having a poor adhering and fastening function in the vertical direction;

(2) As for the adhering and fastening effect in the horizontal direction: where the fibriform hooks and the fibriform loops of the fastening fabric are mutually engaged in the horizontal direction, because the external pulling force is perpendicular to the erected and dispersed restraining fibers, the external pulling force is almost equal to the effective normal component for a resultant torque, and the ineffective parallel component with respect to the resultant torque is near to zero, so the external pulling force is able to pull the erected and dispersed restraining fibers with 100% efficiency to easily bend the restraining fibers, and the adhering and fastening effect is thus no longer provided. Moreover, the external pulling force is mostly applied to the top end of the restraining fibers, and the bottom end of the restraining fibers are served as pivots, so the rotating torques would amplify the external force; because the longer the length of the restraining fiber, the greater the torque, the restraining fibers would be more easily bent, and the micro-fibriform loops would be more easily released from the restraining fibers, thus the fastening fabric has a poor adhering and fastening effect in the horizontal direction; and (3) The erected restraining fibers will increase the thickness of the fastening fabric and limit the applicable range of the fastening fabric.

Accordingly, how to effectively increase the tangling force (friction force) between the restraining fibers of the fibriform pile fabric structure and the micro-fibriform loops of the micro-fibriform loop fabric structure shall be seriously concerned by the skilled people in the art.

SUMMARY OF THE INVENTION

One primary objective of the present invention is to provide a fastening fabric which is fabricated by synthetic fibers, with the thermoplastic property thereof, when a restraining fabric structure is processed with a thermal pressing and forming treatment, inclined restraining fibers are able to be thermally pressed and formed, and an included angle is respectively formed between the inclined restraining fibers and a surface of a first base structure, the included angle enables the inclined restraining fibers to be provided with a stiffness (rigidity) against the situation of recovering to the originally erected status, so the inclined restraining fibers are able to sustain a greater external pulling force when being mutually tangled with fibriform loops of a loop fabric structure, thereby enhancing the adhering and fastening effect of the fastening fabric.

For achieving said objective, one technical solution provided by the present invention is to provide a fastening fabric fabricated by synthetic fibers and comprising: a restraining fabric structure, processed with a thermal pressing and forming treatment, wherein the restraining fabric structure comprises a first base structure and a plurality of fiber bundles protruding from a surface of the first base structure, and each of the fiber bundles comprises a plurality of inclined restraining fibers, wherein the plural inclined restraining fibers are formed with a rigidity and inclined towards a same direction, and respectively formed with an included angle with respect to the surface of the first base structure, wherein the included angle is greater than 5 degrees but smaller than 60 degrees; and a loop fabric structure, comprising a second base structure and a plurality of loop bundles protruding from a surface of the second base structure, wherein each of the loop bundles comprises a plurality of fibriform loops; when the restraining fabric structure and the loop fabric structure are in contact for being mutually adhered, the inclined restraining fibers and the fibriform loops are tangled with each other for providing an adhering and fastening effect.

Another objective of the present invention is to provide a fastening fabric which is fabricated by synthetic fibers, with the thermoplastic property thereof, when a restraining fabric structure is processed with a thermal pressing and forming treatment, inclined restraining fibers are able to be thermally pressed and formed, and an included angle is respectively formed between the inclined restraining fibers and a surface of a first base structure, the included angle enables the inclined restraining fibers to be provided with a stiffness (rigidity) against the situation of recovering to the originally erected status; and a planar loop fabric structure is formed as a plurality of planar fibriform loops arranged on a plane; so the inclined restraining fibers are able to sustain a greater external pulling force when being mutually tangled with the fibriform loops, thereby enhancing the adhering and fastening effect of the fastening fabric, and the planar loop fabric structure is able to further reduce the thickness of the fastening fabric, thereby increasing the applicable range of the fastening fabric.

For achieving said objective, one technical solution provided by the present invention is to provide a fastening fabric fabricated by synthetic fibers and comprising: a restraining fabric structure, processed with a thermal pressing and forming treatment, wherein the restraining fabric structure comprises a first base structure and a plurality of fiber bundles protruding from a surface of the first base structure, and each of the fiber bundles comprises a plurality of inclined restraining fibers, wherein the plural inclined restraining fibers are all formed with a rigidity and inclined towards a same direction, and respectively formed with an included angle with respect to the surface of the first base structure, wherein the included angle is greater than 5 degrees but smaller than 60 degrees; and a planar loop fabric structure, comprising a plurality of planar loop bundles arranged on a plane, wherein each of the planar loop bundles comprises a plurality of planar fibriform loops; when the restraining fabric structure and the planar loop fabric structure are in contact for being mutually adhered, the inclined restraining fibers and the planar fibriform loops are tangled with each other for providing an adhering and fastening effect.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
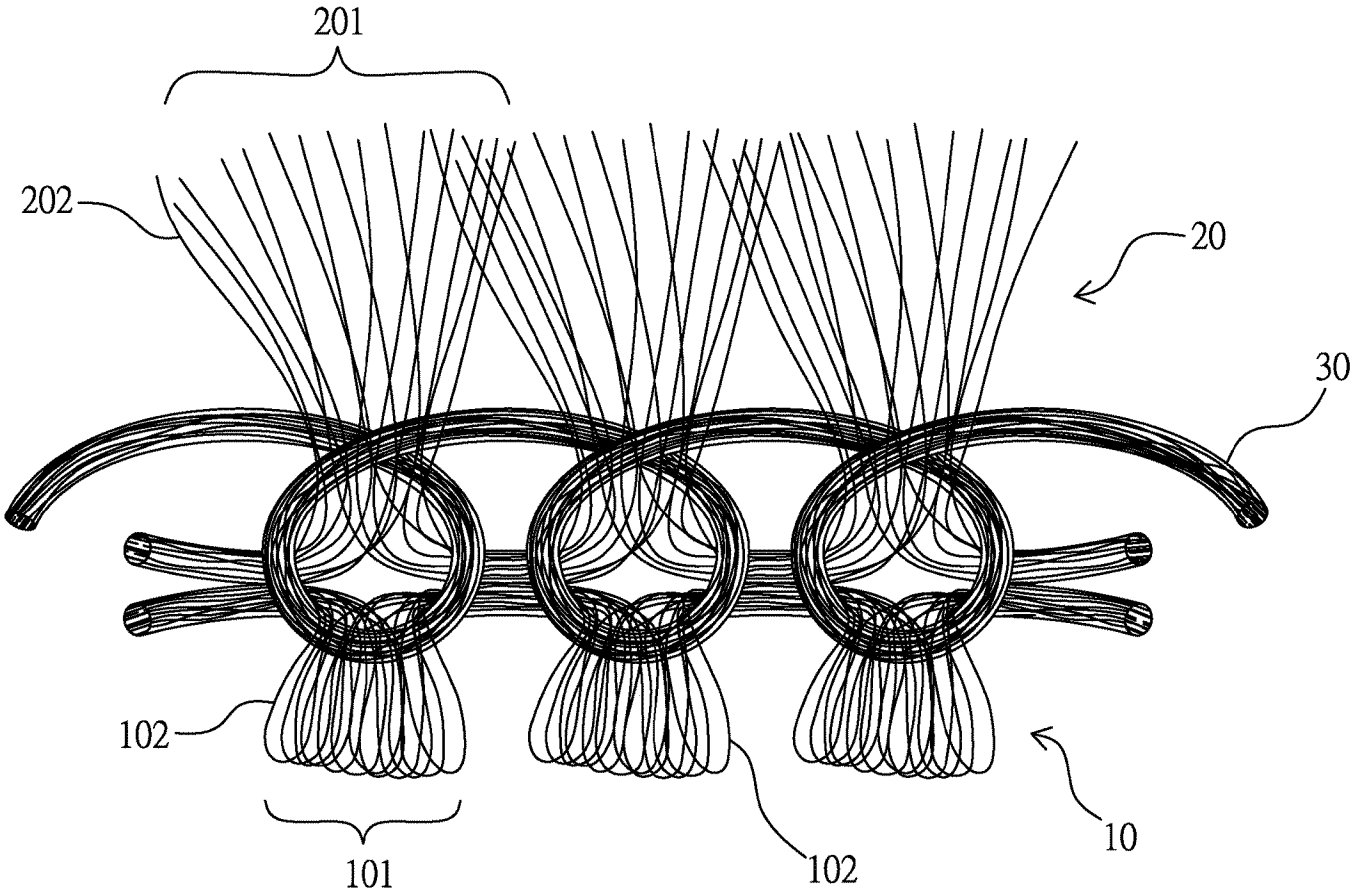
(PRIOR ART) FIG. 1
FIG. 1 is a partially enlarged view illustrating erected and dispersed restraining fibers of a fibriform pile fabric structure of a conventional fastening fabric.
Figure 2:
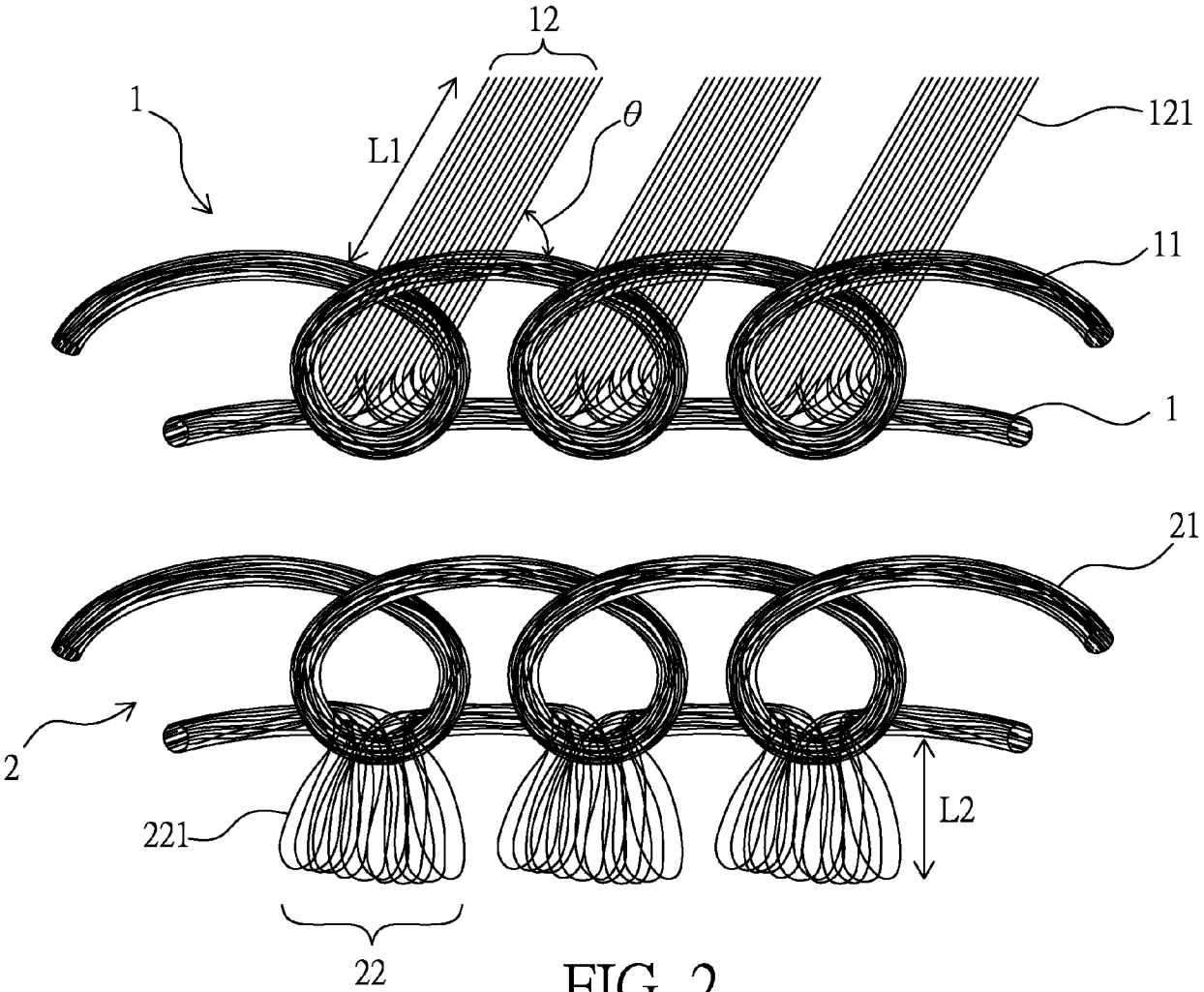
FIG. 2 is a partially enlarged view illustrating a restraining fabric structure and a loop fabric structure of the fastening fabric according to the present invention.

Referring to FIG. 2, the present invention provides a fastening fabric, which comprises a restraining fabric structure 1 which is a fabric structure processed with a thermal pressing and forming treatment, the restraining fabric structure 1 comprises a first base structure 11 and a plurality of fiber bundles 12 protruding from a surface of the first base structure 11, and each of the fiber bundles 12 comprises a plurality of inclined restraining fibers 121, wherein the plural inclined restraining fibers 121 are all formed with a rigidity and inclined towards a same direction, and respectively formed with an included angle with respect to the surface of the first base structure 11, wherein the included angle is preferably to be greater than 5 degrees but smaller than 60 degrees, and more preferably to be greater than 15 degrees but smaller than 50 degrees.

The texturing and fabricating means for the restraining fabric structure 1 are disclosed as follows:

(1) a fabric having loop-pile fabricated through circular knitting, warp knitting or weaving filament yarns is provided, wherein the warp knitting is able to fabricate loop-pile fabric having elasticity in both weft and warp directions; the top ends of the loop-pile formed on the surface of the first base structure 11 of the fabric are sheared so as to form the restraining fabric structure 1, the restraining fabric structure 1 comprises the above-mentioned fiber bundles 12, and each of the fiber bundles 12 comprises the plural restraining fibers 121, after the restraining fabric structure 1 is processed with a thermal pressing and forming treatment, the plural inclined restraining fibers 121 are all formed with a rigidity and inclined towards a same direction, and respectively formed with an included angle with respect to the surface of the first base structure 11, wherein the included angle is greater than 5 degrees but smaller than 60 degrees, so that an enhanced adhering and fastening function can be provided; and (2) a double-layer fabric fabricated through circular knitting, warp knitting or weaving filament yarns is provided, the double-layer fabric is divided into two pieces of fabrics, the above-mentioned restraining fabric structure 1 is fabricated on a surface of any of the fabrics, the restraining fabric structure 1 comprises the above-mentioned fiber bundles 12, and each of the fiber bundles 12 comprises the plural restraining fibers 121, after the restraining fabric structure 1 is processed with a thermal pressing and forming treatment, the plural inclined restraining fibers 121 are all formed with a rigidity and inclined towards a same direction, and respectively formed with an included angle with respect to the surface of the first base structure 11, wherein the included angle is greater than 5 degrees but smaller than 60 degrees, so that an enhanced adhering and fastening function can be provided.

The fastening fabric further comprises a loop fabric structure 2, the fibriform loop fabric structure 2 comprises a second base structure 21 and a plurality of fibriform loop bundles 22 protruding from a surface of the second base structure 21, and each of the loop bundles 22 comprises a plurality of fibriform loops 221. As such, when the restraining fabric structure 1 and the loop fabric structure 2 are in contact for being mutually adhered, the inclined restraining fibers 121 and the fibriform loops 221 are tangled with each other, so that a soft material, such as a fabric, is provided with an adhering and fastening effect.

As such, in practical implementations, the size of the fibriform loops 221 are smaller than 5 deniers, when the denier of a fibriform loop 221 is smaller than 0.5, the loop fabric structure 2 is able to be fabricated by utilizing composite fibers and using a fiber splitting treatment, after the composite fibers are split by a conventional chemical or mechanical method forming micro-fibers, micro-fibers having more amount of fibers than the original composite fibers and having finer size than the original composite fibers are fabricated. And a height (L2) defined by the loop bundles 22 protruding from the surface of the second base structure 21 is from 0.2 mm to 4 mm.

Wherein, in practical implementations, thermal shrinkable fibers can be added in the loop fabric structure 2, so the high temperatures generated during a dyeing treatment is able to allow the thermal shrinkable fibers to shrink, thereby enabling the fibriform loops 221 which are not shrinkable to be in a more loosened status.

The composite fibers can be sea-island composite fibers or segment-pie composite fibers; the fiber splitting treatment for the former one includes a weight reduction treatment for dissolving and removing the sea portions and only saving the island portions, so as to provide microfibers, and the fiber splitting treatment for the later one can be a mechanical fiber splitting treatment or a reduction fiber splitting treatment, so as to provide microfibers.

As such, the fiber splitting treatment is performed on the loop bundles 22 on the surface of the second base structure so as to fabricate the micro-fibriform loops 221, and the micro-fibriform loops 221 and the inclined restraining fibers 121 are able to provide an enhanced adhering and fastening function.

The size of the micro-fibriform loop 221 and the size of the inclined restraining fiber 121 are properly chosen for achieving an effect of easily tangling with each other; for example, polyester filament yarns of 150D (denier)/48f (fiber count) are adopted as the restraining fibers 121, microfibers of 80D/72*12f are adopted as the micro-fibriform loops 221; the size of the restraining fiber 121 is 3.125D/f, and the size of the micro-fibriform loop 221 is 0.093D/f. If the size of 1D/f is adopted as the size of the fibriform loop 221 so that the strength of each single fiber of the fibriform loop 221 can be increased, the size of the restraining fiber 121 is preferably greater than 6D/f.

In addition, the restraining fabric structure 1 of the fastening fabric and the loop fabric structure 2 of the fastening fabric can be fabricated by a circular knitted or warp knitted or woven fabric having double-face loop structure, so the inclined fiber bundles 12 and the loop bundles 22 are respectively fabricated on different surfaces of the fabric, and after the plural loops of the restraining fabric structure 1 are processed with the shearing treatment and the thermal pressing and forming treatment, the plural inclined fiber bundles 12 of the restraining fabric structure 1 are fabricated on one surface of the fabric and the plural loop bundles 22 of the loop fabric structure 2 are fabricated on the other surface of the fabric.

Figure 3:
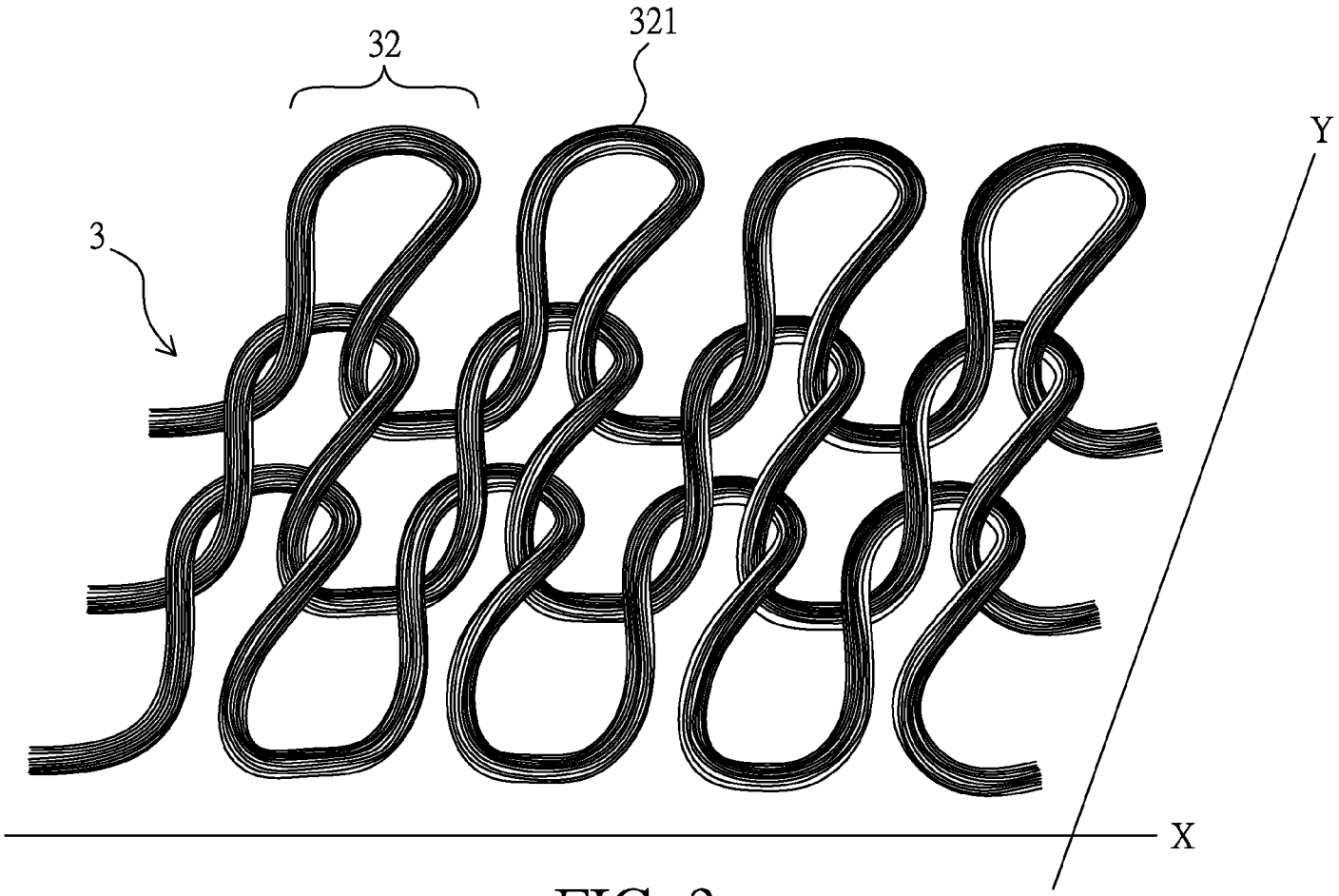
FIG. 3 is a partially enlarged view illustrating the loop fabric structure according to another embodiment of the present invention.

Referring to FIG. 3, which shows another embodiment of the loop fabric structure provided by the present invention, the loop fabric structure disclosed in the previous embodiment is altered to a planar loop fabric structure 3 which does not protrude from the surface of a base structure, for example a single-face planar circular knitted fabric, so the thickness of the loop fabric structure can be reduced and thereby expand the applicable range. As such, when the planar loop fabric structure 3 is implemented, planar loop bundle 32 are limited on a plane defined by an X axis and a Y axis; when the size of the fiber is less than 1 denier, the plural planar loop bundles 32 fabricated through knitting or weaving composite fibers can be processed with a fiber splitting treatment, so that each of the planar loop bundles 32 is formed with a plurality of planar fibriform loops 321.

The planar loop fabric structure 3 can be fabricated by a circular knitted or warp knitted or woven fabric having single-face loop-pile structure, so the restraining fabric structure 1 and the planar loop fabric structure 3 are respectively fabricated on different surfaces of the fabric, and the restraining fabric structure 1 is fabricated through performing the shearing treatment and the thermal pressing and forming treatment. When the fastening fabric is fabricated by the single-face loop-pile structure, during the shearing treatment, the length of the fiber of the restraining fabric structure 1 on one surface of the fabric can be set to a shorter length, and with the planar fibriform loops 321 of the planar loop fabric structure 3 on another surface of the fabric, the fabric is provided with features of thin and soft, which is suitably to be used as a fabric for wrapping.

As shown in FIG. 2, an inclined angle θ is formed between the restraining fiber 121 and the first base structure 11 to enable an external pulling force to result in an effective vertical friction force, thereby enhancing the vertical adhering and fastening effect.

As mentioned above, the reasons why the restraining fibers erectly and loosely fabricated on a conventional fastening fabric having a poor vertical adhering and fastening effect has been clearly explained, however in practical applications, not only the vertical adhering and fastening effect of the fastening fabric should be concerned, the horizontal adhering and fastening effect shall also be put into considerations, so that the actual requirements thereof can be satisfied.

As shown in FIG. 2, the inclined angle θ is formed between the restraining fibers 121 and the first base structure 11, and the inclined angle θ is able to reduce the effective normal component of the external pulling force for a resultant torque, so that the restraining fibers 121 are more capable of fighting against the external pulling force, thereby enhancing the adhering and fastening effect of the fastening fabric in the horizontal direction.

As such, the normal component and the parallel component of the action force (external pulling force) are determined according to the inclined angle θ, when the inclined angle is greater than 60 degrees, the adhering and fastening effect provided in both the vertical direction and the horizontal direction is not effectively increased; when the inclined angle is 45 degrees, the adhering and fastening effect provided in both the vertical direction and the horizontal direction is effectively increased; when the inclined angle is smaller than 5 degrees, the adhering and fastening effect provided in both the vertical direction and the horizontal direction is significantly increased, but the restraining fibers 121 in an overly inclined status would be less easily tangled with the fibriform loops 221. Accordingly, the inclined angle defined between the restraining fibers 121 and the first base structure 11 is preferably to be greater than 5 degrees but smaller than 60 degrees, and more preferably to be greater than 15 degrees but smaller than 50 degrees.

Moreover, the inclined fiber bundles 12 of the restraining fabric structure 1 are fabricated by using a shearing treatment and going through a process for a proper time in an environment with proper pressures and temperatures, the condition of the process is as follows: the temperature is between 140 to 250 Celsius degree, and under a proper pressure, a thermal pressing and forming treatment is performed for 10 to 60 seconds, so the inclined restraining fibers 121 are provided with a rigidity after the thermal pressing and forming treatment, meanwhile the thermal pressing and forming treatment also enables the structural body formed through weaving the restraining fabric structure 1 and the first base structure 11 to be more firmly, so the inclined fiber bundles 12 are enabled to stably erect, and the adhering and fastening effect of the fastening fabric can be further enhanced.

Furthermore, the fiber length of the inclined fiber bundles 12 of the restraining fabric structure 1 protruding from the surface of the first base structure 11 would affect the whole thickness of the restraining fabric structure 1, and the resultant torque of the action force is also affected, so the length (L1) of the restraining fiber 121 is preferably from 0.2 mm to 5 mm, and more preferably from 0.4 mm to 3 mm.

Furthermore, the condition and the required equipment for the thermal pressing and forming treatment of the restraining fabric structure 1 is similar to the process method of a sublimation paper printing, so, if the sublimation paper printing is adopted for fabricating the restraining fabric structure 1 of the fastening fabric, the thermal pressing and forming treatment can be omitted.

According to the present invention, the texturing means of the fastening fabric is circular knitting, warp knitting or weaving a fabric, if elastic fibers are added in the first base structure 11 and the second base structure 21, such as the elastic fibers under the trademark of Lycra, the elasticity of the fastening fabric can be increased and the fastening fabric can be suitably applied in wrapping or bonding a protection equipment.

Figure 4:
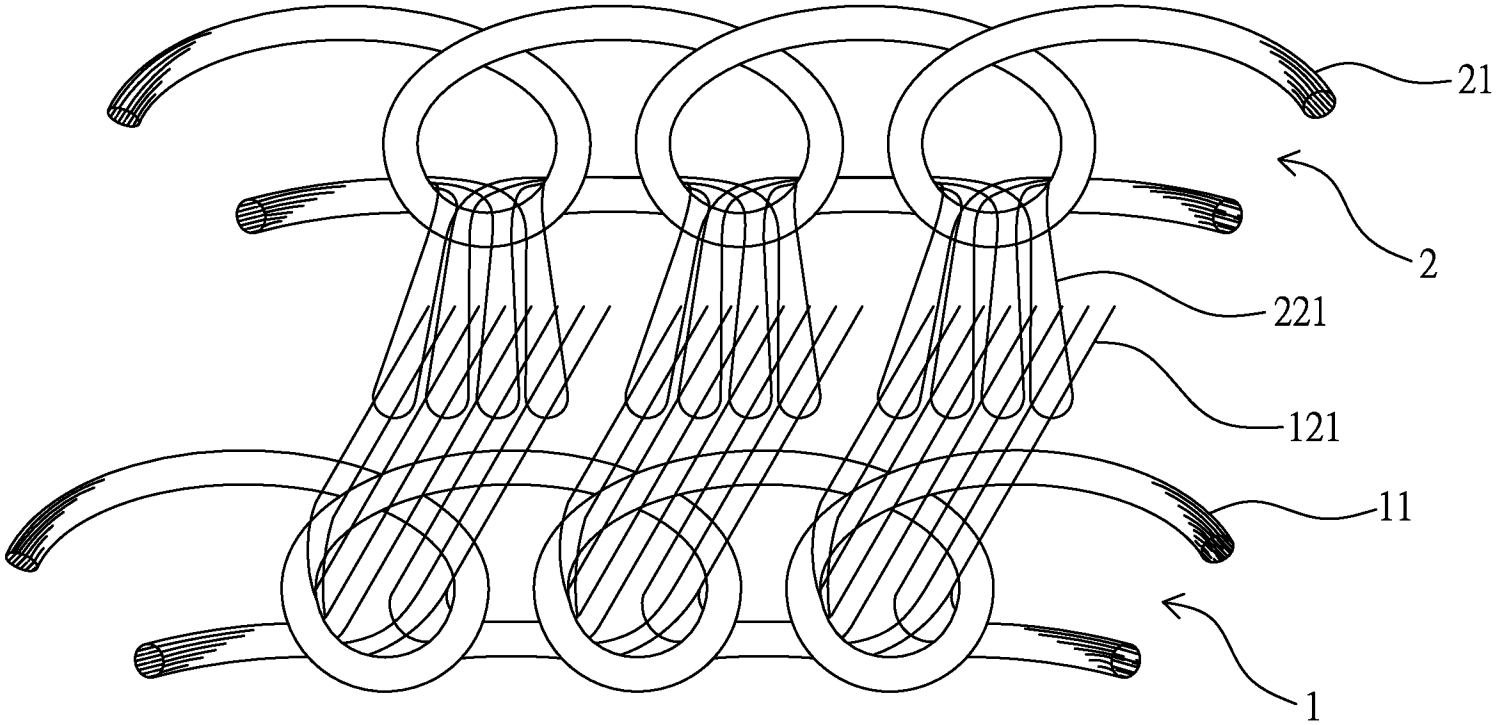
FIG. 4 is a schematic view illustrating the restraining fabric structure being tangled and fastened with the loop fabric structure.

Referring to FIG. 4, when the restraining fabric structure 1 and the loop fabric structure 2 are in contact for being mutually adhered, the inclined restraining fibers 121 and the fibriform loops 221 are mutually hooked or tangled and thus a great friction force is generated, so a soft material, such as a fabric, can thereby provide an adhering and fastening effect.

Figure 5:
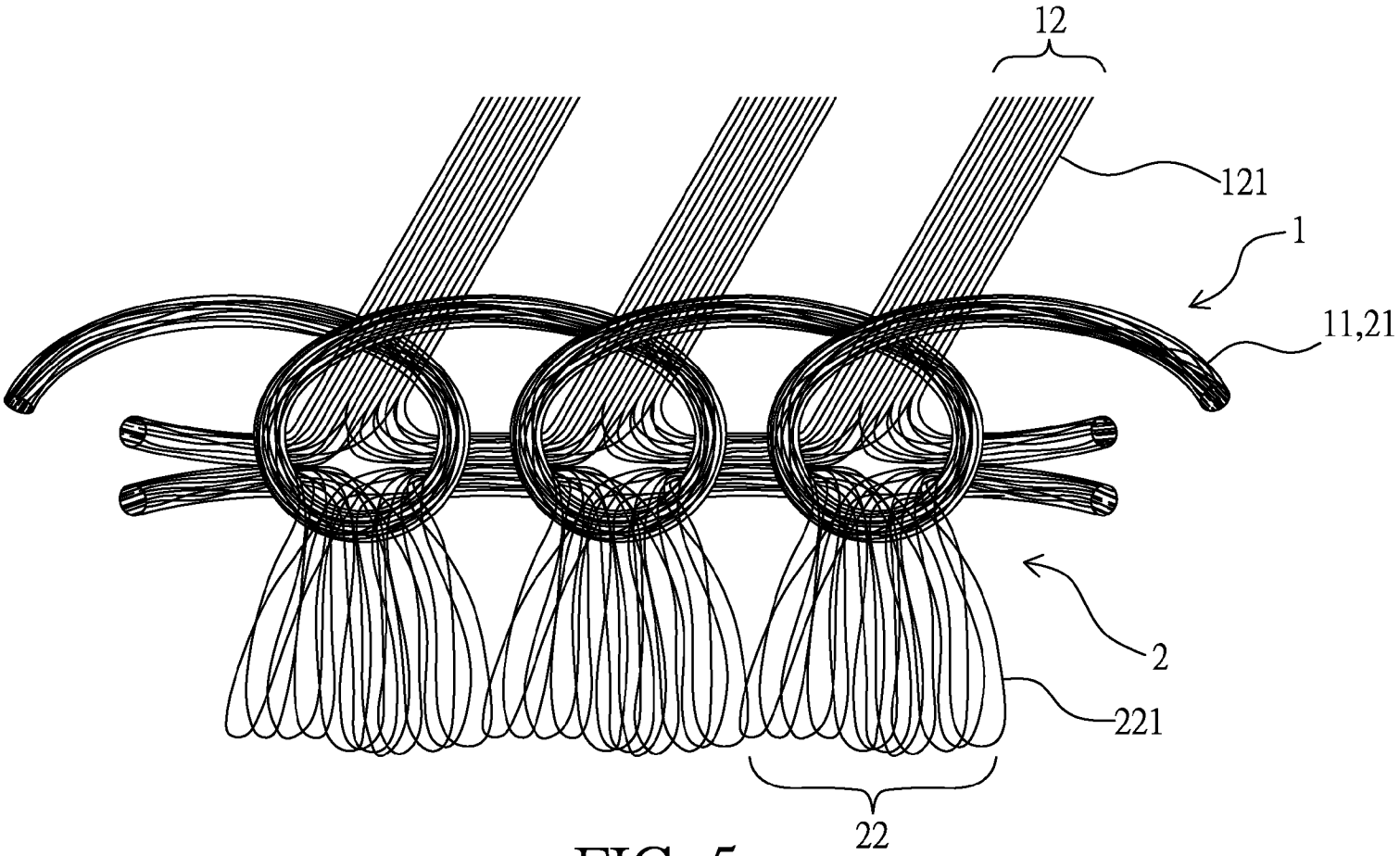
FIG. 5 is a schematic view illustrating the restraining fabric structure and the loop fabric structure being fabricated on different surfaces of a fabric.

Referring to FIG. 5, in this embodiment, the inclined fiber bundles 12 of the restraining fabric structure 1 and the loop bundles 22 of the loop fabric structure 2 are fabricated on different surfaces of the same fabric, in other words the first base structure 11 of the restraining fabric structure 1 and the second base structure 21 of the loop fabric structure 2 are the same base structure, so the fabric is able to utilize the circular knitted, warp knitted or woven fabric having double-face loop structure to respectively fabricate the restraining fabric structure 1 and the loop fabric structure 2 on different surfaces of the fabric; when different surfaces of the fastening fabric are in contact for being mutually adhered, the plural restraining fibers 121 of the inclined fiber bundles 12 of the restraining fabric structure 1 will be tangled with the plural fibriform loops 221 of the loop bundles 22 of the loop fabric structure 2, and a great friction force will be formed, thereby achieving the adhering and fastening function.

Figure 6:
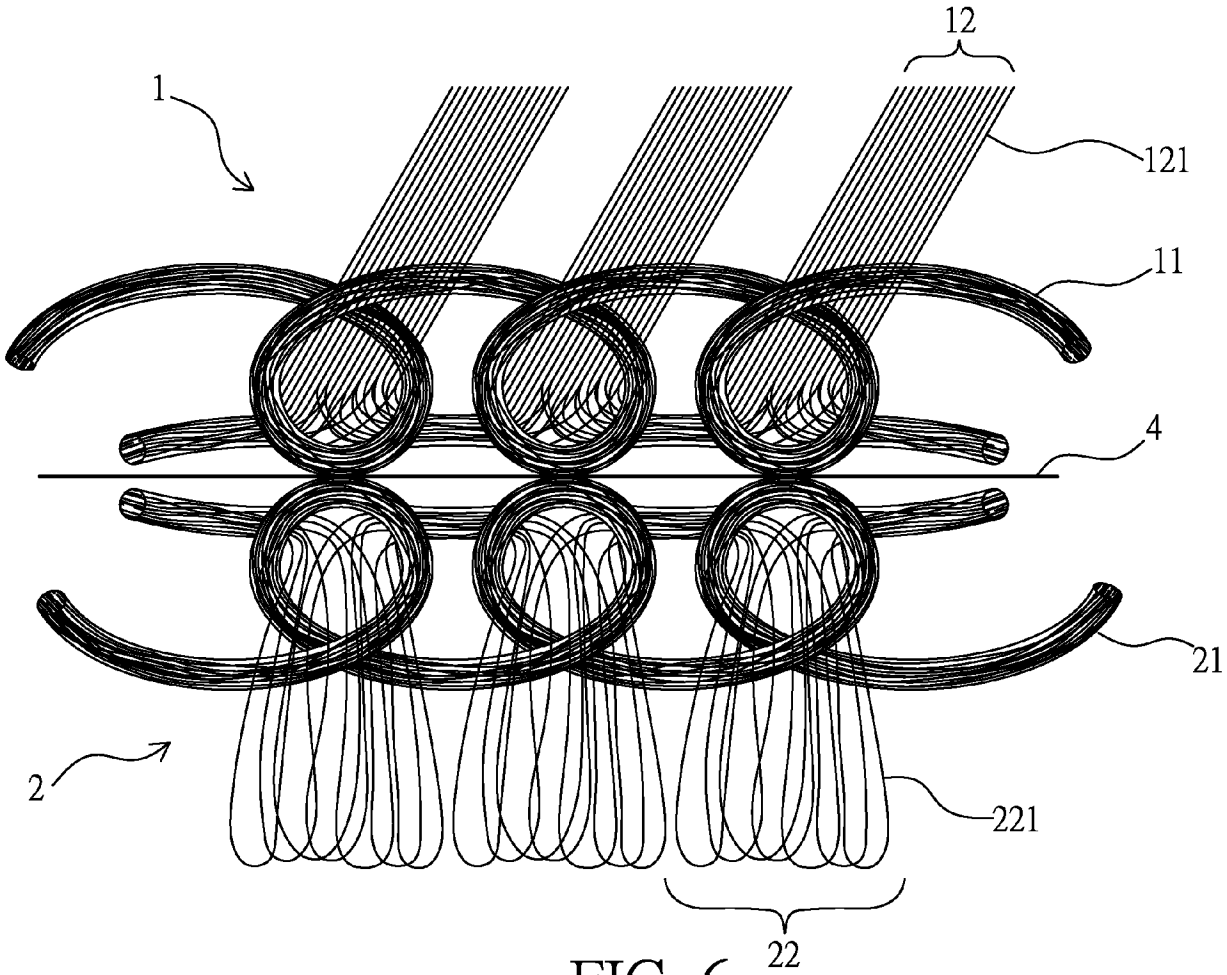
FIG. 6 is a schematic view illustrating the restraining fabric structure and the loop fabric structure being fabricated on two different pieces of fabrics, then bonded together to form a resultant fabric of which two opposite faces being able to be adhered to each other when in contact.

Referring to FIG. 6, which discloses another embodiment of the fastening fabric provided by the present invention, the restraining fabric structure 1 and the loop fabric structure 2 are formed on two different pieces of fabrics, a non-adhering surface thereof is respectively adhered with an adhering layer 4, such as a double-sided tape or coating an adhesive layer, so the restraining fabric structure 1 and the loop fabric structure 2 can be more stable and easy to be tailored, and can be combined at different locations of a product for being used as a fastening member.

Figure 7:
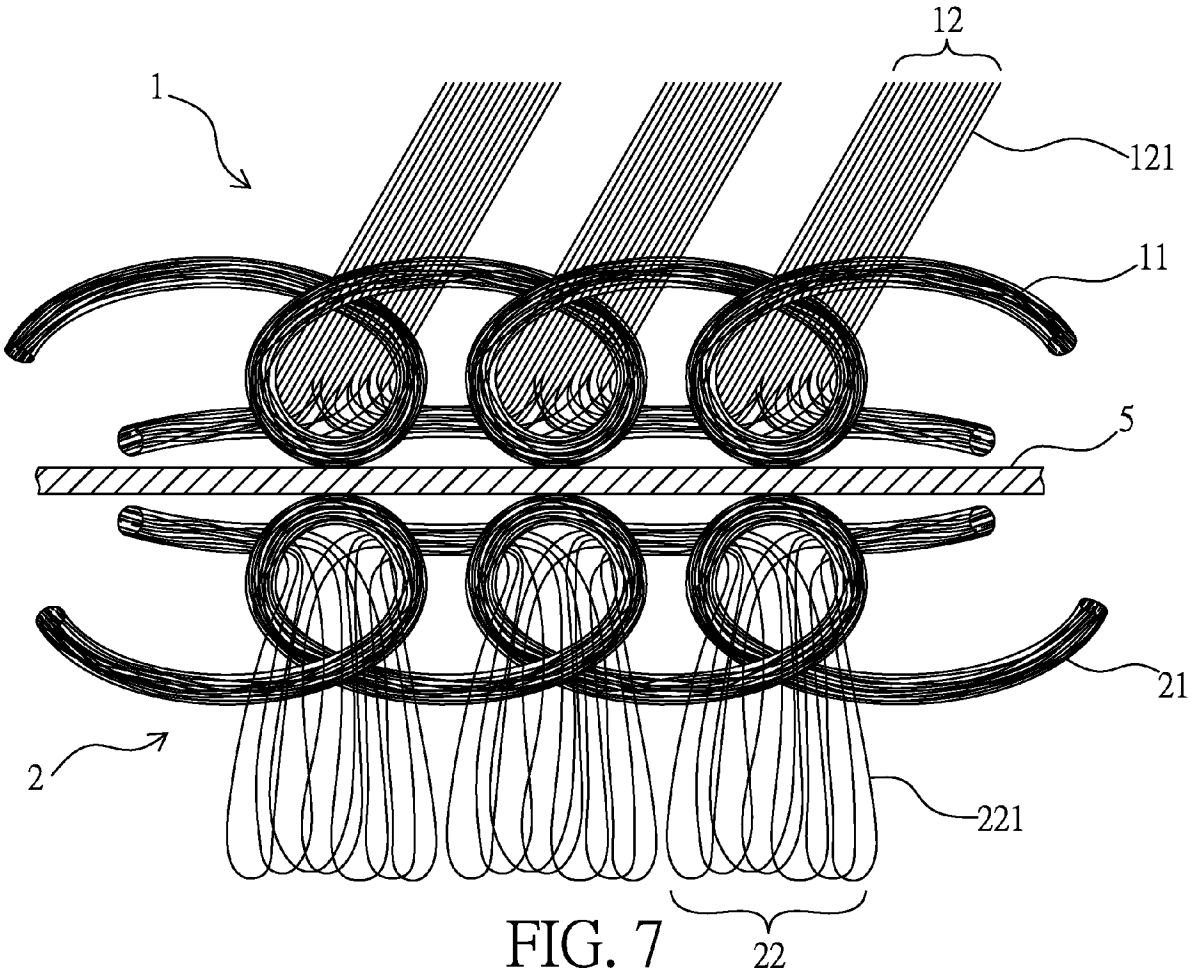
FIG. 7 is a schematic view illustrating the restraining fabric structure and the loop fabric structure being fabricated on two different pieces of fabrics, then bonded together to form a resultant fabric of which two opposite faces being able to be adhered to each other when in contact, wherein an intermediate member is bonded therebetween.

Referring to FIG. 7, which disclosed still another embodiment of the fastening fabric provided by the present invention, the restraining fabric structure 1 and the loop fabric structure 2 are fabricated on two different pieces of fabrics, then bonded together to form a resultant fabric of which two opposite faces can be adhered to each other when in contact, and an intermediate member 5 is disposed between the two structures, such as an elastic film or a micro porous air-pervious film. Comparing this embodiment to the embodiment disclosed in FIG. 5, this embodiment is able to provide a stronger elasticity for being applied to a protection equipment requiring a strong bonding capability.

The elastic film or the micro porous air-pervious film of the intermediate member 5 can be selected from neoprene foam, thermoplastic polyurethane (TPU) air impervious film, thermoplastic polyurethane (TPU) breathable film, polytetrafluoroethene (PTFE) breathable film or elastic fabric.

Figure 8:
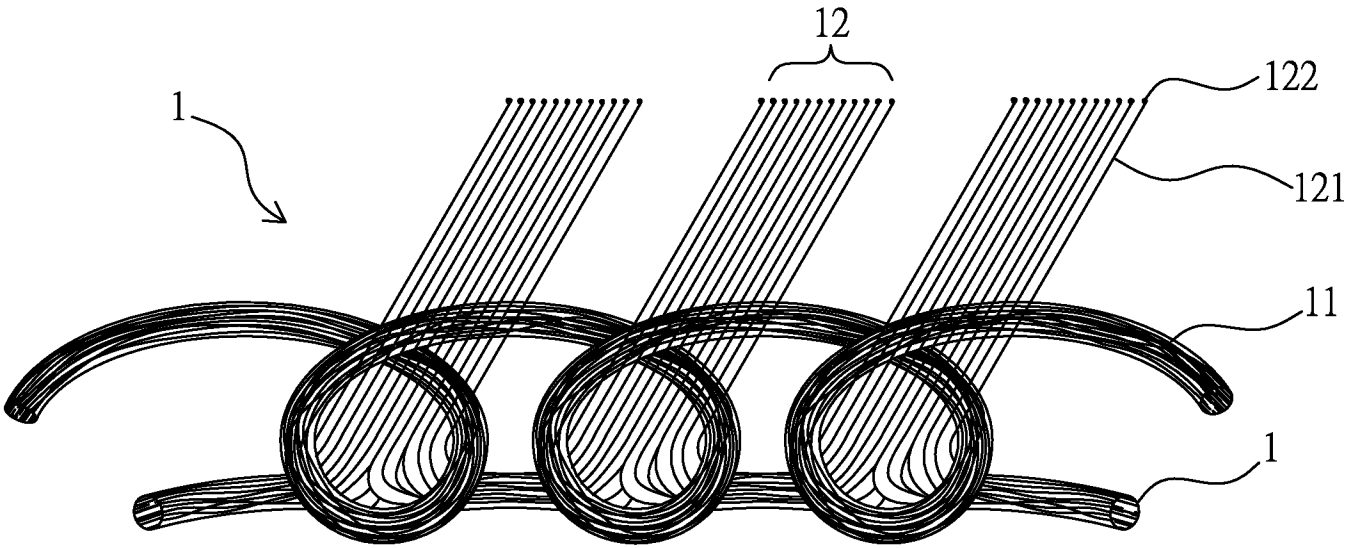
FIG. 8 is a partially enlarged view illustrating the restraining fiber of the fastening fabric being formed with a spherical distal end according to the present invention.

Please refer to FIG. 8, which discloses another embodiment of the restraining fabric structure provided by the present invention. The inclined fiber bundles 12 of the restraining fabric structure 1 are fabricated through a shearing treatment and a thermal pressing and forming treatment, if a singeing treatment is processed between the shearing treatment and the thermal pressing and forming treatment, free ends of the restraining fibers 121 will be respectively formed with a spherical distal end 122, the spherical distal ends 122 are able to provide a function similar to the hooks of a conventional VELCRO tape, so the friction force generated when the fastening fabric is mutually hooked or tangled can be increased, thereby enhancing the adhering and fastening effect.

As mentioned above, the technical features of the fastening fabric provided by the present invention are: the fastening fabric can be fabricated by synthetic fibers, and the material thereof can be selected from polyester, nylon, polypropylene or acrylic, but not limited thereto; the synthetic fiber can also be the textured yarns of polyester, Nylon, polypropylene or acrylic, so that properties of fluffiness and curliness can be provided, and the friction force coefficient can be increased, thereby enhancing the adhering and fastening effect. After the restraining fabric structure 1 is processed with the shearing treatment and the thermal pressing and forming treatment, an included angle is respectively formed between the inclined restraining fibers 121 and the surface of the first base structure 11, and the included angle is greater than 5 degrees but smaller than 60 degrees.

In addition, the restraining fabric structure 1 can be fabricated by the synthetic fibers, and the size of each single fiber thereof is greater than 3 deniers but smaller than 30 deniers, and the restraining fibers 121 can be added with a far infrared emitting material such as zirconia, germanium or active carbon for providing a skin warming effect.

Moreover, hydrophilic fiber such as polyacrylate, wool or cotton can be added or adopted as the base structures 11, 21, so that an effect of temperature maintaining effect can be provided by taking advantages of the moisture absorbing and heat releasing functions of the fibers.

Furthermore, the size of each single fiber of the fibriform loops 221 is preferably smaller than 5 deniers, and the material can be selected from polyester, nylon, polypropylene or acrylic, but not limited thereto.

As mentioned above, the softness and the fiber size of the fastening fabric is almost the same as a daily-used cloth, and with the great adhering and fastening force generated when the massive amount of the inclined restraining fibers 121 are tangled with the fibriform loops 221, 321, a fabric having adhering and fastening function without needs of any additional fastening member is provided.

Based on what has been disclosed above, advantages achieved by the present invention are as follows:

(1) The adhering and fastening effect of the fastening fabric can be greatly enhanced, after the inclined restraining fibers are processed with the thermal pressing and forming treatment, an included angle is respectively formed between the inclined restraining fibers and the surface of the first base structure, so the plural inclined fibers are provided with a stiffness (rigidity) against the situation of recovering to the originally erected status, the inclined fibers are able to sustain a greater external force when being mutually tangled with the fibriform loops, thereby enhancing the adhering and fastening effect of the fastening fabric.

(2) With the thermoplastic property of the synthetic fibers, when the restraining fabric structure is processed with the thermal pressing and forming treatment, the first base structure is also processed with the thermal pressing and forming treatment with the restraining fabric structure, so the structure of the first base structure and the restraining fabric structure can be more firmly, and the inclined fibers are provided with a greater stiffness against the situation of recovering to the originally erected status, thereby enhancing and increasing the adhering and fastening function of the fastening fabric.

(3) With the thermoplastic property of the synthetic fibers, after the restraining fabric structure is processed with the thermal pressing and forming treatment, an included angle is respectively formed between the plural inclined restraining fibers and the surface of the first base structure, so when the inclined restraining fibers are mutually tangled with the fibriform loops, the included angle is able to divide an external pulling force into a normal component and a parallel component to enable the inclined restraining fibers to provide a hooking effect similar to a conventional hook to increase the adhering and fastening strength in the vertical direction, thereby enhancing and increasing the adhering and fastening function of the fastening fabric.

(4) With the thermoplastic property of the synthetic fibers, after the restraining fabric structure is processed with the thermal pressing and forming treatment, an included angle is respectively formed between the plural inclined restraining fibers and the surface of the first base structure, with various arrangements of the length and the included angle of the inclined restraining fibers, the thickness and the adhering and fastening effect in the vertical direction and in the horizontal direction can be predesigned, thereby enhancing the designing efficiency for the fastening fabric.

(5) The restraining fibers and the fibriform loops of the fastening fabric can be respectively fabricated on the front surface and the rear surface of single fabric, and with the restraining fibers having shorter length working with the planar loop fabric structure, the thickness can be effectively reduced, and the softness of the fastening fabric can be enhanced, and because the fastening fabric is provided with the excellent water absorbing property, the fastening fabric can be freely adhered and applied to a scarf, a shawl or a towel.

(6) Because the fastening fabric can be woven in the same manner as a cloth, the shape thereof can be freely tailored, and an all-direction adhering function is provided; when the fastening fabric is applied to a bonding tape, the bonding tape can be bonded on different parts of the body, so the applicable range is extremely wide.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A fastening fabric, fabricated by synthetic fibers and comprising:

a restraining fabric structure, processed with a thermal pressing and forming treatment, wherein said restraining fabric structure comprises a first base structure and a plurality of fiber bundles protruding from a surface of said first base structure, and each of said fiber bundles comprises a plurality of inclined restraining fibers, wherein said plural inclined restraining fibers are formed with a rigidity and inclined towards a same direction, and respectively formed with an included angle with respect to said surface of said first base structure, wherein said included angle is greater than 5 degrees but smaller than 60 degrees; and a loop fabric structure, comprising a second base structure and a plurality of loop bundles protruding from a surface of said second base structure, wherein each of said loop bundles comprises a plurality of fibriform loops;

when said restraining fabric structure and said loop fabric structure are in contact for being mutually adhered, said inclined restraining fibers and said fibriform loops are tangled with each other to provide an adhering and fastening effect.

2. The fastening fabric as claimed in claim 1, wherein the material of said restraining fabric structure is selected from the textured yarns of polyester, Nylon, polypropylene or acrylic.

3. The fastening fabric as claimed in claim 1, wherein said included angle is greater than 15 degrees but smaller than 50 degrees.

4. The fastening fabric as claimed in claim 1, wherein the length defined by said plural inclined restraining fibers protruding from said surface of said first base structure is 0.2 mm to 5 mm.

5. The fastening fabric as claimed in claim 4, wherein the length defined by said plural inclined restraining fibers protruding from said surface of said first base structure is 0.4 mm to 3 mm.

6. The fastening fabric as claimed in claim 1, wherein said restraining fabric structure is fabricated by fibers having a size of 3 to 30 deniers.

7. The fastening fabric as claimed in claim 1, wherein said restraining fabric structure is fabricated by a fabric having loop-pile fabricated through circular knitting, warp knitting or weaving filament yarns, top ends of said loop-pile are sheared, and said thermal pressing and forming treatment is performed for fabricating said inclined restraining fibers.

8. The fastening fabric as claimed in claim 1, wherein said restraining fabric structure is fabricated by a fabric having loop-pile fabricated through circular knitting, warp knitting or weaving filament yarns, top ends of said loop-pile are sheared, a singeing treatment is performed for allowing free ends of said plural restraining fibers to be respectively formed with a spherical distal end, and said thermal pressing and forming treatment is performed for fabricating said inclined restraining fibers.

9. The fastening fabric as claimed in claim 1, wherein said restraining fabric structure is fabricated by a double-layer fabric fabricated through circular knitting, warp knitting or weaving filament yarns, said double-layer fabric is divided into two pieces of fabrics, and said thermal pressing and forming treatment is performed for fabricating said inclined restraining fibers.

10. The fastening fabric as claimed in claim 1, wherein said restraining fabric structure is fabricated by a double-layer fabric fabricated through circular knitting, warp knitting or weaving filament yarns, said double-layer fabric is divided into two pieces of fabrics, a singeing treatment is processed for allowing free ends of said plural restraining fibers to be respectively formed with a spherical distal end, and said thermal pressing and forming treatment is performed for fabricating said inclined restraining fibers.

11. The fastening fabric as claimed in claim 1, wherein said thermal pressing and forming treatment is performed at a temperature between 140 to 250 Celsius degree in an environment with proper pressures, and an operation of thermal pressing and forming lasts for 10 to 60 seconds.

12. The fastening fabric as claimed in claim 1, wherein said thermal pressing and forming treatment is a sublimation printing process.

13. The fastening fabric as claimed in claim 1, wherein a size of said fibriform loop of said loop fabric structure is smaller than 5 deniers.

14. The fastening fabric as claimed in claim 1, wherein the fiber of said fibriform loop of said loop fabric structure is processed with a fiber splitting treatment in a chemical or mechanical method for fabricating microfibers with a size smaller than 1 denier.

15. The fastening fabric as claimed in claim 1, wherein elastic fibers are added in said first base structure and said second base structure.

16. The fastening fabric as claimed in claim 1, wherein said first base structure and said second base structure share a same base structure, so that said inclined restraining fibers of said restraining fabric structure and said fibriform loops of said loop fabric structure are fabricated on different surfaces of a same fabric.

17. The fastening fabric as claimed in claim 1, wherein said inclined restraining fibers of said restraining fabric structure and said fibriform loops of said loop fabric structure are fabricated on two different pieces of fabrics.

18. The fastening fabric as claimed in claim 1, wherein said inclined restraining fibers of said restraining fabric structure and said fibriform loops of said loop fabric structure are fabricated on two different pieces of fabrics, then bonded together to form a resultant fabric of which two opposite faces can be adhered to each other when in contact.

19. The fastening fabric as claimed in claim 1, wherein said inclined restraining fibers of said restraining fabric structure and said fibriform loops of said loop fabric structure are fabricated on two different pieces of fabrics, an intermediate member is bonded therebetween to form a resultant fabric of which two opposite faces can be adhered to each other when in contact.

20. The fastening fabric as claimed in claim 19, wherein said intermediate member is selected from neoprene foam, thermoplastic polyurethane (TPU) air impervious film, thermoplastic polyurethane (TPU) breathable film, polytetrafluoroethene (PTFE) breathable film or elastic fabric.

21. A fastening fabric, fabricated by synthetic fibers and comprising:

a restraining fabric structure, processed with a thermal pressing and forming treatment, wherein said restraining fabric structure comprises a first base structure and a plurality of fiber bundles protruding from a surface of said first base structure, and each of said fiber bundles comprises a plurality of inclined restraining fibers, wherein said plural inclined restraining fibers are formed with a rigidity and inclined towards a same direction, and respectively formed with an included angle with respect to said surface of said first base structure, wherein said included angle is greater than 5 degrees but smaller than 60 degrees; and a planar loop fabric structure, comprising a plurality of planar loop bundles arranged on a plane, wherein each of said planar loop bundles comprises a plurality of fibriform loops;

when said restraining fabric structure and said loop fabric structure are in contact for being mutually adhered, said inclined restraining fibers and said fibriform loops are tangled with each other to provide an adhering and fastening effect.

22. The fastening fabric as claimed in claim 21, wherein the material of said restraining fabric structure is selected from the textured yarns of polyester, Nylon, polypropylene or acrylic.

23. The fastening fabric as claimed in claim 21, wherein said included angle is greater than 15 degrees but smaller than 50 degrees.

24. The fastening fabric as claimed in claim 21, wherein the length defined by said plural inclined restraining fibers protruding from said surface of said first base structure is 0.2 mm to 5 mm.

25. The fastening fabric as claimed in claim 24, wherein the length defined by said plural inclined restraining fibers protruding from said surface of said first base structure is 0.4 mm to 3 mm.

26. The fastening fabric as claimed in claim 21, wherein said restraining fabric structure is fabricated by fibers having a size of 3 to 30 deniers.

27. The fastening fabric as claimed in claim 21, wherein said restraining fabric structure is fabricated by a fabric having loop-pile fabricated through circular knitting, warp knitting or weaving filament yarns, top ends of said loop-pile are sheared, and said thermal pressing and forming treatment is performed for fabricating said inclined restraining fibers.

28. The fastening fabric as claimed in claim 21, wherein said restraining fabric structure is fabricated by a fabric having loop-pile fabricated through circular knitting, warp knitting or weaving filament yarns, top ends of said loop-pile are sheared, a singeing treatment is performed for allowing free ends of said plural restraining fibers to be respectively formed with a spherical distal end, and said thermal pressing and forming treatment is performed for fabricating said inclined restraining fibers.

29. The fastening fabric as claimed in claim 21, wherein said restraining fabric structure is fabricated by a double-layer fabric fabricated through circular knitting, warp knitting or weaving filament yarns, said double-layer fabric is divided into two pieces of fabrics, and said thermal pressing and forming treatment is performed for fabricating said inclined restraining fibers.

30. The fastening fabric as claimed in claim 21, wherein said restraining fabric structure is fabricated by a double-layer fabric fabricated through circular knitting, warp knitting or weaving filament yarns, said double-layer fabric is divided into two pieces of fabrics, a singeing treatment is processed for allowing free ends of said plural restraining fibers to be respectively formed with a spherical distal end, and said thermal pressing and forming treatment is performed for fabricating said inclined restraining fibers.

31. The fastening fabric as claimed in claim 21, wherein said thermal pressing and forming treatment is performed at a temperature between 140 to 250 Celsius degree in an environment with proper pressures, and an operation of thermal pressing and forming lasts for 10 to 60 seconds.

32. The fastening fabric as claimed in claim 21, wherein said thermal pressing and forming treatment is a sublimation printing process.

33. The fastening fabric as claimed in claim 21, wherein a size of said fibriform loop of said loop fabric structure is smaller than 5 deniers.

34. The fastening fabric as claimed in claim 21, wherein the fiber of said fibriform loop of said planar loop fabric structure is processed with a fiber splitting treatment in a chemical or mechanical method for fabricating microfibers with a size smaller than 1 denier.

35. The fastening fabric as claimed in claim 21, wherein elastic fibers are added in said first base structure and said second base structure.

36. The fastening fabric as claimed in claim 21, wherein said inclined restraining fibers of said restraining fabric structure and said fibriform loops of said loop fabric structure are fabricated on two different pieces of fabrics.

37. The fastening fabric as claimed in claim 21, wherein said inclined restraining fibers of said restraining fabric structure and said fibriform loops of said loop fabric structure are fabricated on two different pieces of fabrics, then bonded together to form a resultant fabric of which two opposite faces can be adhered to each other when in contact.

38. The fastening fabric as claimed in claim 21, wherein said inclined restraining fibers of said restraining fabric structure and said fibriform loops of said loop fabric structure are fabricated on two different pieces of fabrics, an intermediate member is bonded therebetween to form a resultant fabric of which two opposite faces can be adhered to each other when in contact.

39. The fastening fabric as claimed in claim 38, wherein said intermediate member is selected from neoprene foam, thermoplastic polyurethane (TPU) air impervious film, thermoplastic polyurethane (TPU) breathable film, polytetrafluoroethene (PTFE) breathable film or elastic fabric.

* * * * *